US011784439B2

(12) United States Patent
Listing et al.

(10) Patent No.: US 11,784,439 B2
(45) Date of Patent: Oct. 10, 2023

(54) MINIATURIZED CONNECTOR

(71) Applicant: TE Connectivity Germany GmbH, Bensheim (DE)

(72) Inventors: Martin Listing, Bensheim (DE); Christoph Kosmalski, Bensheim (DE); Maximilian Veihl, Bensheim (DE); Monika Stein, Bensheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 21 days.

(21) Appl. No.: 17/231,528

(22) Filed: Apr. 15, 2021

(65) Prior Publication Data

US 2021/0328386 A1 Oct. 21, 2021

(30) Foreign Application Priority Data

Apr. 17, 2020 (DE) ..... 10 2020 204 913.0

(51) Int. Cl.
*H01R 13/52* (2006.01)
*H01R 13/652* (2006.01)

(52) U.S. Cl.
CPC ..... *H01R 13/652* (2013.01); *H01R 13/5202* (2013.01)

(58) Field of Classification Search
CPC ..... H01R 13/652; H01R 13/5202; H01R 13/4362; H01R 13/6271; H01R 13/6592; H01R 9/05; H01R 9/0518; H01R 12/596
See application file for complete search history.

(56) References Cited

U.S. PATENT DOCUMENTS 3,336,563 A * 8/1967 Hyslop ..... H01R 13/422 174/DIG. 8
3,439,294 A * 4/1969 Flanagan ..... H01R 9/0518 333/260
3,480,722 A * 11/1969 Van Horssen ..... 174/75 C
3,533,051 A * 10/1970 Ziegler, Jr. ..... H01R 9/0503 439/585
4,408,821 A * 10/1983 Forney, Jr. ..... H01R 9/05 439/585
4,412,717 A * 11/1983 Monroe ..... H01R 9/0518 439/582

(Continued)

FOREIGN PATENT DOCUMENTS

EP 2200130 A1 6/2010
JP 2017-098103 A 6/2017

(Continued)

OTHER PUBLICATIONS

Extended European Search Report in Appln. No. 21168806.4-1201, dated Sep. 10, 2021, 26 pp.
German Office Action, dated Jan. 22, 2021, 10 pages.

*Primary Examiner* — Thanh Tam T Le
(74) *Attorney, Agent, or Firm* — Barley Snyder

(57) ABSTRACT

A connector includes a housing and a shielding contact. A gap running in a circumferential direction extends between the housing and the shielding contact. A mating housing of a mating connector is adapted to be inserted into the gap in a plugging direction. The gap opens in the plugging direction into a sealing section in which a sealing ring is retained axially between the shielding contact and the housing.

15 Claims, 3 Drawing Sheets

(56) References Cited

U.S. PATENT DOCUMENTS 4,444,453 A * 4/1984 Kirby ..... H01R 9/0521 439/583
4,540,231 A * 9/1985 Forney, Jr. ..... H01R 9/05 439/585
4,596,435 A * 6/1986 Bickford ..... H01R 24/542 439/582
4,755,152 A * 7/1988 Elliot ..... H01R 13/5216 174/75 C
4,813,887 A * 3/1989 Capp ..... H01R 24/562 439/585
4,824,399 A * 4/1989 Bogar ..... H01R 24/542 439/642
5,667,405 A * 9/1997 Holliday ..... H01R 13/5219 439/585
5,823,824 A * 10/1998 Mitamura ..... H01R 13/6593 439/585
5,911,599 A * 6/1999 Masuda ..... H01R 13/6592 439/578
6,554,623 B2 * 4/2003 Yoshioka ..... H01R 13/6592 439/98
6,749,464 B2 * 6/2004 Obata ..... H01R 13/6582 439/607.41
6,887,106 B2 * 5/2005 Noguchi ..... H01R 13/6582 439/607.41
7,204,716 B1 * 4/2007 George ..... H01R 13/5205 439/588
7,255,598 B2 * 8/2007 Montena ..... H01R 9/0518 439/585
7,727,015 B2 * 6/2010 Holliday ..... H01R 9/0524 439/584
7,731,536 B2 6/2010 Okayasu
7,824,222 B2 * 11/2010 Miyoshi ..... H01R 13/5845 439/607.41
8,011,977 B2 * 9/2011 Tsuruta ..... H01R 13/4365 439/752
8,333,613 B2 * 12/2012 De Chazal ..... H01R 13/6581 439/607.01
8,337,240 B2 * 12/2012 Feldmeier ..... H01R 13/04 439/681
9,048,587 B2 * 6/2015 Marsh ..... H01R 24/545
9,543,707 B2 * 1/2017 Miyoshi ..... H01R 13/502
10,027,052 B2 * 7/2018 Yudate ..... H01R 13/5202
10,069,269 B2 * 9/2018 Takahashi ..... H01R 43/20
10,074,924 B2 * 9/2018 Yamanaka ..... H01R 13/506
10,741,976 B1 * 8/2020 Maesoba ..... H01R 13/6582
11,088,486 B2 * 8/2021 Maesoba ..... H01R 13/6581
2002/0177341 A1 11/2002 Stein, Sr. et al.
2012/0021645 A1 1/2012 Marsh

FOREIGN PATENT DOCUMENTS

JP 2018-190630 A 11/2018
WO 2010135181 A3 11/2010

* cited by examiner

MINIATURIZED CONNECTOR

CROSS-REFERENCE TO RELATED APPLICATIONS

This application claims the benefit of the filing date under 35 U.S.C. § 119(a)-(d) of German Patent Application No. 102020204913.0, filed on Apr. 17, 2020.

FIELD OF THE INVENTION

The invention relates to a connector and, more particularly, to a miniaturized connector.

BACKGROUND

Connectors are used, for example, in electric vehicles for high-voltage applications. It is particularly important that connector systems withstand electrical, thermal, and mechanical loads reliably and safely. In order to avoid malfunctions or even short circuits in a plug-in system consisting of a connector and a mating connector, sealing elements which seal the plugged system against fluids or at least liquids are provided and are retained in the housing by locking rings. This leads to a high space requirement in the housing, whereby the dimensions of the connector are increased. In the automotive sector in particular, it is desirable to keep the connector or the plug-in system as small as possible.

SUMMARY

A connector includes a housing and a shielding contact. A gap running in a circumferential direction extends between the housing and the shielding contact. A mating housing of a mating connector is adapted to be inserted into the gap in a plugging direction. The gap opens in the plugging direction into a sealing section in which a sealing ring is retained axially between the shielding contact and the housing.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
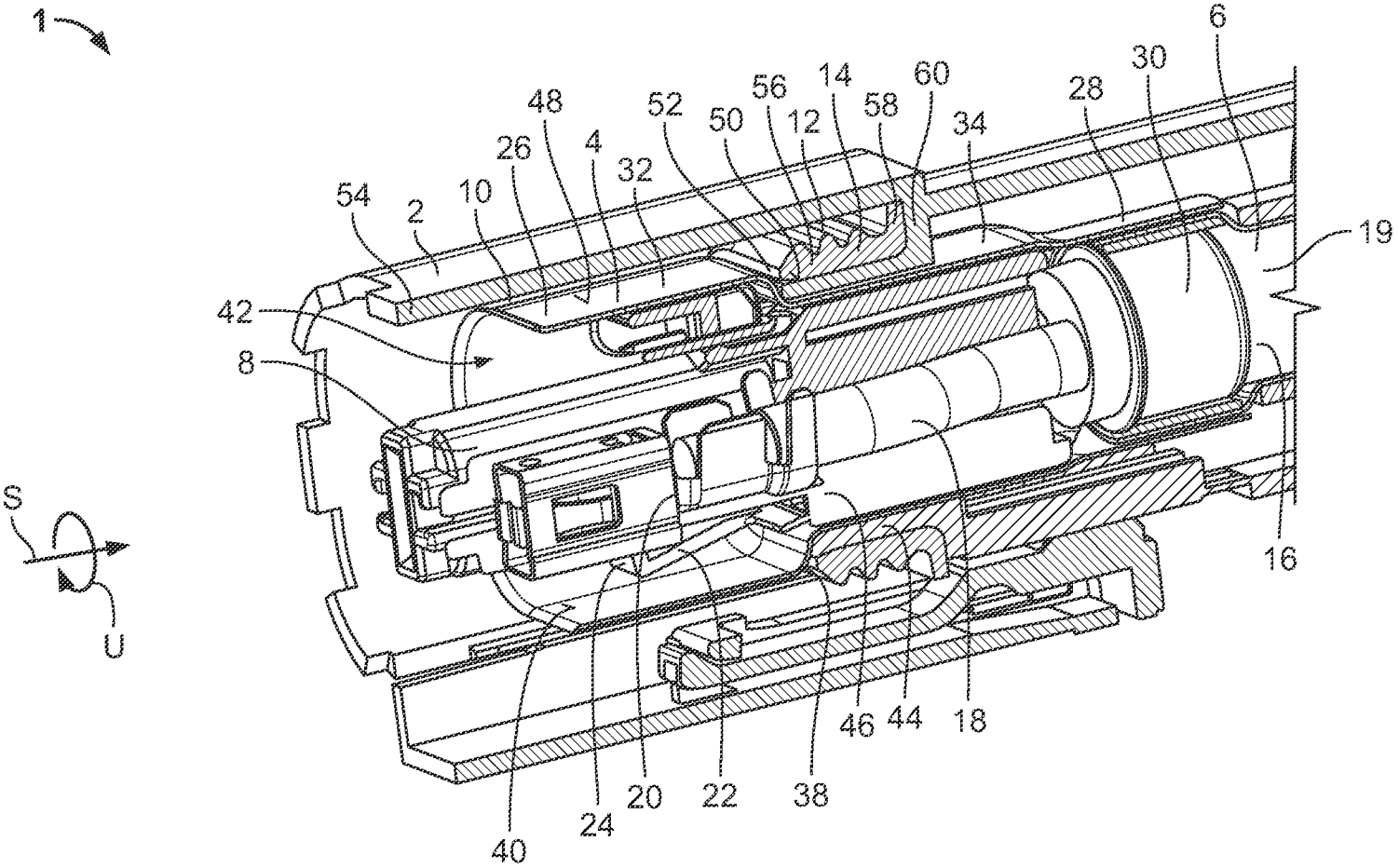
FIG. 1 is sectional perspective view of a connector according to an embodiment.

In the following, the invention shall be described by way of example in more detail using embodiments with reference to the appended figures. Elements in the figures that correspond to one another in terms of structure and/or function are provided with the same reference numerals.

The combinations of features shown and described in the individual embodiments are for explanatory purposes only. In accordance with the explanation herein, a feature of an embodiment may be dispensed with if its technical effect is of no significance for a particular application. Conversely, a further feature may be added in an embodiment should its technical effect be advantageous or necessary for a particular application.

A connector 1 according to an embodiment is shown in FIG. 1. The connector 1 comprises a housing 2 and a shielding contact 4 for shielding an electrical conductor 6 or a plug contact 8, respectively, wherein a gap 10 running in circumferential direction U extends between housing 2 and shielding contact 4. The gap 10 may be inserted in a plugging direction S into a mating housing of a mating connector. Gap 10 opens in plugging direction S into a sealing section 12 in which a sealing ring 14 is retained axially between shielding contact 4 and housing 2. The gap 10 may extend along a radially outer surface of the shielding contact 4. The gap 10 may run coaxially to the shielding contact 4 so that the width of the gap 10 between the shielding contact 4 and the housing 2 is the same in every radial direction of the gap 10.

As a result of the solution according to the invention, the sealing ring 14 may be retained directly by shielding contact 4 against plugging direction S, as a result of which sealing ring 14 may be prevented from slipping out of sealing section 12. An additional locking ring is therefore not necessary, whereby the dimensions of connector 1 may be further reduced.

As shown in FIG. 1, the electrical conductor 6 may be a cable 16. Cable 16, in an embodiment, may be multi-core so that connector 1 is a multi-terminal connector 1, wherein only one of two cores 18 or plug contacts 8, respectively, is shown in the sectional view in FIG. 1. Connector 1 may be particularly suitable for high-voltage applications from around 300 V. Electrical conductor 6 may comprise an insulation 19 which protectively surrounds both cores 18, wherein free ends of cores 18 are freed of insulation 19 and are each able to be connected to a contact terminal 20, for example, by way of a crimp connection.

Exposed cores 18 and contact terminal 20 may be retained in a plug contact 8, shown in FIG. 1, wherein plug contact 8 has an interface for plugging to a mating plug contact of the mating connector. Plug contact 8 may therefore form an inner housing which surrounds at least contact terminal 20 in a protective manner. Contact terminal 20 and/or exposed cores 18 may there be retained by plug contact 8, as a result of which they are protectively surrounded by plug contact 8 as an inner housing. The plug contact 8 may be formed from electrically insulating material, for example, plastic material, whereby the plug contact 8 may additionally form a touch protection for the contact terminal 20.

Plug contact 8 may be provided with what is known as a TPA (terminal position assurance) which is intended to serve as a secondary lock 22 for contact terminal 20 in plug contact 8, as shown in FIG. 1. In this exemplary configuration, secondary lock 22 is configured as a radially deflectable tab 24 which, when contact terminal 20 is fully inserted, may be pressed into an opening of plug contact 8 and in a positive-fit manner prevents movement of contact terminal 20 in plugging direction S relative to plug contact 8.

In order to keep electrical conductor 6, in particular exposed cores 18 and at least the crimping region of contact terminal 20, away from electrical and/or magnetic fields or to protect the surroundings from the fields emanating from the system, shielding contact 4 may sheath plug contact 8 in the crimping region of contact terminal 20 in a sleeve-like manner up to insulation 19 of electrical conductor 6. The shielding contact 4 may be referred to as a shielding sleeve. Shielding contact 4 may, in an embodiment, be formed integrally as a monolithic component 26 in order to conduct shielding currents through the shielding contact without additional transition resistance.

Figure 2:
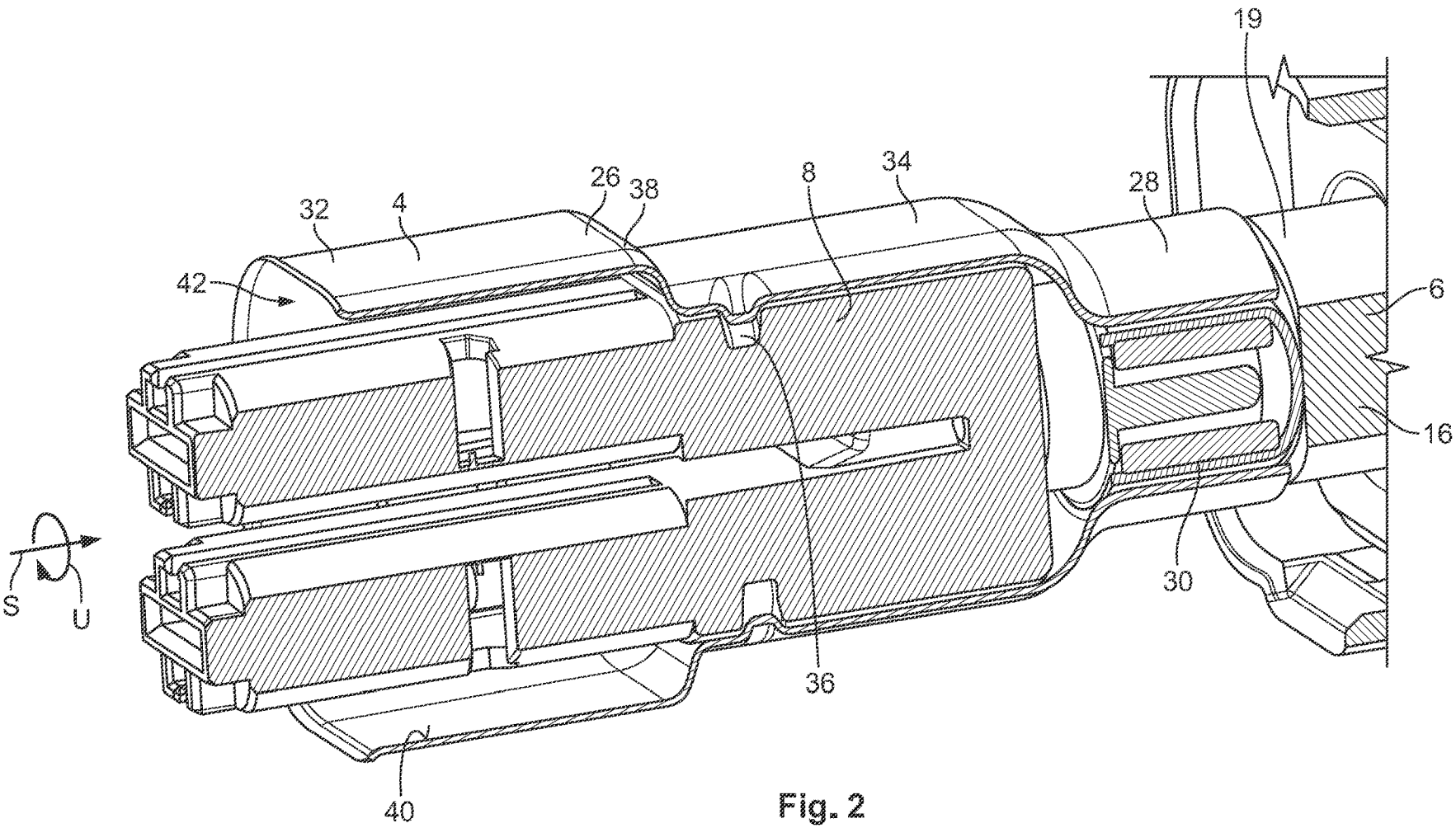
FIG. 2 is a sectional perspective view of a shielding contact of the connector of FIG. 1.

As shown in FIG. 2, shielding contact 4 may extend from a connection section 28, at which shielding contact 4 is crimped to a cable shielding 30 of electrical conductor 6, to a contact section 32 for contacting a shielding of a mating connector. Shielding contact 4, in the shown embodiment, has a sleeve diameter that tapers from contact section 32 in plugging direction S towards connection section 28. In particular, the sleeve diameter may taper in a step-like manner, wherein the functional region of shielding contact 4 may be defined with each step. Since the connection section 28 is to be configured for crimping to the cable shielding 30 of the electrical conductor 6, the shielding contact 4 may have a smaller clear width in the connection section 28 than in the contact section 32.

An attachment section 34 may extend between connection section 28 and contact section 32 for attaching shielding contact 4 to plug contact 8, as shown in FIGS. 1 and 2. Attachment section 34 and/or contact section 32 may have a polygonal cross section so that a substantially polygonal plug contact 8 may be surrounded uniformly by shielding contact 4. Since insulation 19 of cable 16 is often substantially circular, shielding contact 4 in connection section 28 may have a substantially circular cross-section transverse to plugging direction S. The attachment section 34 may have a clear width between the connection section 28 and the contact section 32.

Shielding contact 4 may abut in attachment section 34 against plug contact 8 and may be pressed at its corners disposed in circumferential direction U at least in sections radially inwardly into a corresponding attachment groove 36 of plug contact 8, whereby shielding contact 4 is affixed in the axial direction by way of a positive fit onto plug contact 8. The shielding contact 4 may therefore be rigidly connected in the attachment section 34 to the plug contact 8, for example, by crimping.

Shielding contact 4 may widen radially outwardly in contact section 32 with respect to the remainder of the shielding contact 4, whereby a radially projecting shoulder 38 is formed. In this exemplary configuration shown in FIGS. 1 and 2, radially projecting shoulder 38 may extend circumferentially in circumferential direction U, so that the shoulder 38 projects radially in every radial direction with respect to the remainder of shielding contact 4. However, a plurality of radially projecting shoulders 38 spaced from one another in circumferential direction U may also be provided. The shoulder 38 may be formed, for example, as a widening of a sleeve body of the shielding contact 4. The shoulder 38 may form a free end of the shielding contact 4 which is open towards a connector face of the connector 1. In order to increase the rigidity of the shielding contact 4 and thereby to avoid undesired deformation, in particular of the at least one radially projecting shoulder 38, the shielding contact 4 may be a deep-drawn component.

Due to the widening in contact section 32, the clear width of shielding contact 4 in contact section 32 increases, so that a radial inner surface 40 of shielding contact 4 in contact section 32 is at least in part spaced from plug contact 8 in the radial direction, as shown in FIGS. 1 and 2. This forms a receptacle 42 into which a mating plug contact of a mating connector may be inserted, so that a shielding of the mating connector may contact radial inner surface 40 of shielding contact 4. In order to avoid contact corrosion, shielding contact 4 may be coated, in an embodiment with tin and/or silver. The coating may be applied, for example, by electroplating.

As shown in FIG. 1, plug contact 8 may be held in housing 2 together with shielding contact 4. For this purpose, a projection 44 extending in plugging direction S is provided which is configured as a hollow body and its passage opening 46 is penetrated by shielding contact 4 and plug contact 8. Shielding contact 4 is inserted with its attachment section 36, at least in sections, with a precise fit in the radial direction in passage opening 46, so that projection 44 rigidly affixes shielding contact 4 and plug contact 8 in the radial direction in the housing 2. The projection 44 may be formed integrally with the housing 2 as a monolithic housing.

As a result of the shoulder 38 created, not only may the sealing ring 14 be affixed in the axial direction between the shielding contact 4 and the housing 2, but the shielding contact 4 in the housing 2 as well. The shoulder 38 may abut against the projection 44 in the plugging direction when the shielding contact 4 is pressed in and prevent further movement of the shielding contact 4 relative to the housing 2 in the plugging direction.

Connection section 28 and contact section 32 may be arranged on different sides of projection 44, wherein contact section 32 in an embodiment directly adjoins projection 44 in the axial direction and projects beyond it in the radial direction with its radially projecting shoulder 38. A radial outer surface 48 of contact section 32 projects over a radial outer surface 50 of the projection, so that an undercut 52 is formed in plugging direction S into which sealing ring 14 is inserted. Contact section 32 is spaced in the radial direction from an outer housing wall 54, so that gap 10 is formed between shielding contact 4 and housing 2.

Sealing ring 14 may be slipped around projection 44 so that it abuts against the radial outer surface 50 of the projection 44, as shown in FIG. 1. The sealing ring 14, in an embodiment, has a substantially L-shaped body, wherein one arm 56 of the body abuts against radial outer surface 50 of the projection and another arm 58 extends radially away from radial outer surface 50 of the projection and closes sealing section 12 in plugging direction S. To stabilize arm 58 in plugging direction S, arm 58 may be supported on a housing wall 60 extending in the radial direction, so that arm 58 cannot be deflected in plugging direction S. Arm 58, in an embodiment, extends from radial outer surface 50 in the radial direction up to outer housing wall 54 and abuts against its inner surface. Projection 44 may project from housing wall 60 in the axial direction, so that projection 44, outer housing wall 58, and housing wall 60 form a pocket into which sealing ring 14 is inserted.

Sealing ring 14 is retained in sealing section 12 in the axial direction between housing wall 60 and shielding contact 4, so that sealing ring 14 may be prevented from being accidentally pulled out of sealing section 12 when a plugged mating connector is unplugged. Sealing ring 14, in particular arm 56 of sealing ring 14 abutting against the projection 44, may project in the radial direction over the shielding contact 4, so that the mating housing of the mating connector may come into engagement with sealing ring 14 in a sealing manner in the radial direction without touching the shielding contact 4. Wear of shielding contact 4 due to abrasion on the mating housing may then be prevented, in particular with high mating cycles.

In order to improve the stability of shielding contact 4, in particular on the radially projecting shoulder 38, shielding contact 4 may be a deep-drawn component. This may prevent shielding contact 4 from being deformed in the event of a load, for example, when pressing sealing ring 14 in the axial direction against shoulder 38.

An exemplary configuration of a plug assembly 62 according to the invention shall now be described below with reference to FIG. 3. The exemplary configuration of plug assembly 62 comprises connector 1 shown in FIG. 1 and a mating connector 64 with a mating housing 66 and a mating plug contact 68. The plug assembly 62 may also be referred to as a connector assembly.

Figure 3:
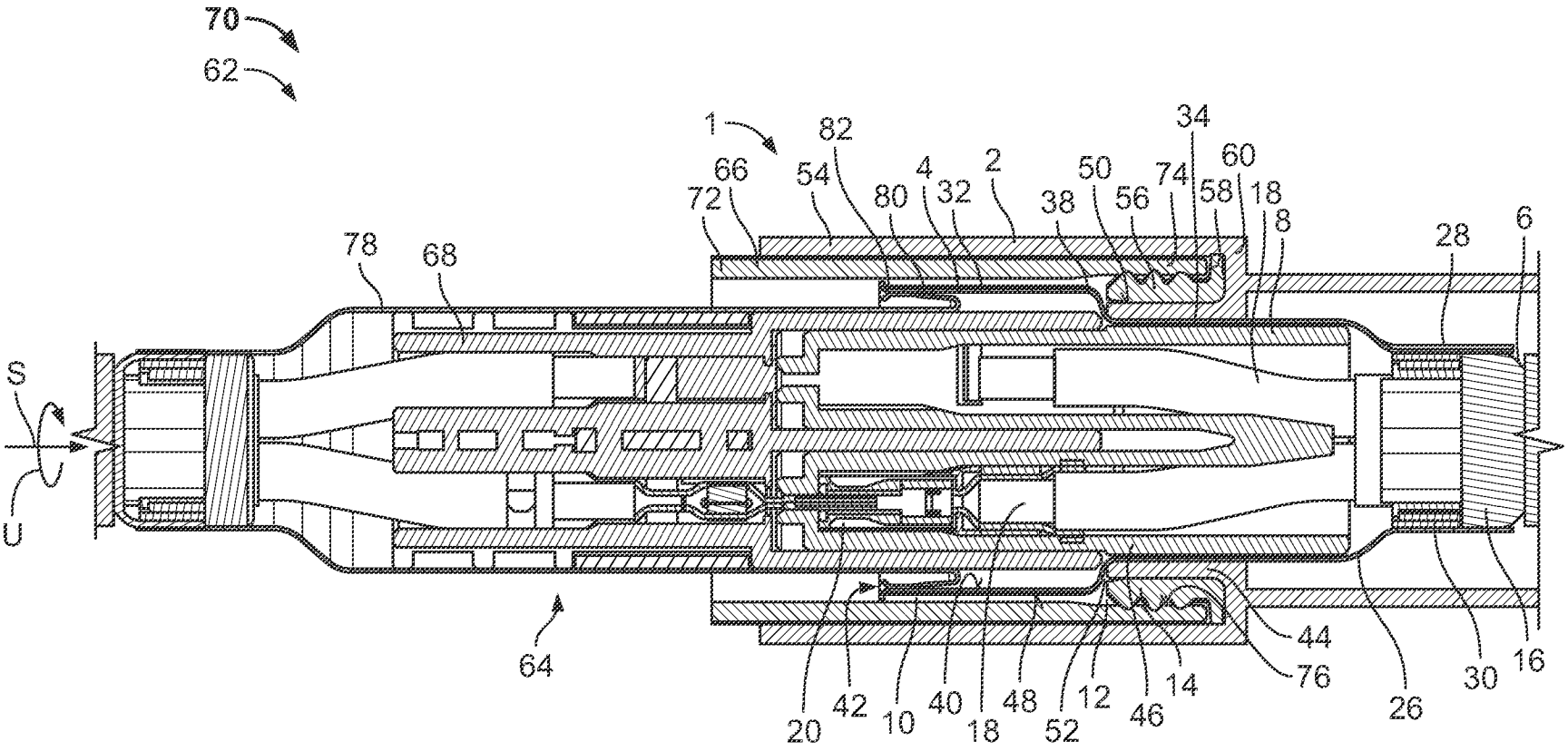
FIG. 3 is a sectional side view of a plug assembly according to an embodiment.

FIG. 3 shows plug assembly 62 in a plugged state 70. Mating housing 66 is at least in part plugged into housing 2, so that a wall 72 of the mating housing slides along outer housing wall 54 of housing 2 in plugging direction S and a free end 74 of wall 72 is pushed through gap 10 into sealing section 12. Free end 74 of wall 72 may abut against sealing ring 14 in plugging direction S, whereby a seal is established in the axial direction between free end 74 of wall 72 and arm 58 of sealing ring 14. Furthermore, arm 56 abutting against projection 44 may be pressed against an inner surface 76 of the wall in order to create a seal in the radial direction.

As shown in FIG. 3, inner surface 76 of wall 72 is spaced in the radial direction from radial outer surface 48 of shielding contact 4, so that wall 72 and shielding contact 4 do not rub against one another during the plugging or unplugging process.

Mating connector 62 comprises a sleeve-shaped shielding 78 which is crimped onto a cable shielding of mating connector 62 and extends in the axial direction along mating plug contact 68. A free end of shielding 78 may be bent back radially outwardly, thereby forming a resilient contact spring 80 which is pre-tensioned radially outwardly. In the plugged state, the mating plug contact 68 is at least in sections inserted into receptacle 42 of shielding contact 4, so that contact spring 80 establishes contact with the radial inner surface 40 of shielding contact 4.

Reliable and constant contact of shielding contact 4 may be ensured by way of resilient contact spring 80 even in the event of vibration loads.

Shielding contact 4 on its radial inner surface 40 has a contact zone 82 which is disposed on its end facing the opening. The coating of shielding contact 4 may be applied better in this region, as a result of which corrosion resistance may be further improved. By establishing contact with shielding contact 4 on the latter's radial inner surface 40, the dimensions of plug assembly 62 may be further reduced, since no additional space is required in the gap 10 for the shielding of the mating connector 62.

As a result of the connector 1 according to the invention, the sealing ring 14 is now secured directly by the shielding contact 4 and an additional locking ring may be dispensed with. Consequently, less space needs to be provided in the interior of the housing 2 because the locking ring no longer needs to be mounted inside the housing 2. The shielding contact 4 therefore not only ensures electromagnetic compatibility of the plug-in system, but at the same time also secures the position of the sealing ring 14 in the axial direction. By eliminating the locking ring, not only is the space required in the housing 2 reduced, but also the cost and weight of the connector 1. The invention therefore allows miniaturization of the connector 1.

What is claimed is:

1. A connector, comprising:

a housing having a projection extending in an axial direction; and a shielding contact formed of a conductive material, a gap running in a circumferential direction extends between the housing and the shielding contact, a mating housing of a mating connector is adapted to be inserted into the gap in a plugging direction, the gap opens in the plugging direction into a sealing section in which a sealing ring is held around the projection of the housing and retained axially between the shielding contact and the housing, a first end of the sealing ring abuts against the shielding contact, a second end of the sealing ring opposite the first end in the plugging direction abuts against the housing, and a bottom surface of the sealing ring extending between the first end and the second end abuts against the housing.

2. The connector of claim 1, wherein the gap extends along a radial outer surface of the shielding contact.

3. The connector of claim 1, wherein the shielding contact has a radially projecting shoulder that axially limits the sealing section.

4. The connector of claim 3, wherein the radially projecting shoulder abuts against the projection in the plugging direction.

5. The connector of claim 1, wherein the sealing ring projects over the shielding contact in a radial direction.

6. The connector of claim 1, wherein a section of the sealing ring closes the gap in the plugging direction.

7. The connector of claim 6, wherein the sealing ring has a radially projecting arm that closes the gap in the plugging direction.

8. The connector of claim 1, wherein the shielding contact extends from a connection section to a contact section, the connection section is for connecting to a shielding braid of an electrical conductor and the contact section is for contacting a shielding of the mating connector.

9. The connector of claim 8, wherein the shielding contact tapers from the contact section to the connection section.

10. The connector of claim 8, wherein the shielding contact has an attachment section extending between the connection section and the contact section.

11. The connector of claim 10, wherein the attachment section attaches the shielding contact to a plug contact.

12. The connector of claim 1, wherein the shielding contact is formed integrally as a monolithic component.

13. A plug assembly, comprising:

a connector including a housing having a projection extending in an axial direction and a shielding contact formed of a conductive material, a gap running in a circumferential direction extends between the housing and the shielding contact, the gap opens in a plugging direction into a sealing section in which a sealing ring is held around the projection of the housing and retained axially between the shielding contact and the housing, a first end of the sealing ring abuts against the shielding contact, a second end of the sealing ring opposite the first end in the plugging direction abuts against the housing, and a bottom surface of the sealing ring extending between the first end and the second end abuts against the housing; and a mating connector having a mating housing adapted to be plugged into the housing and inserted into the gap in the plugging direction, the mating housing presses against the sealing ring in the sealing section in a plugged state.

14. The plug assembly of claim 13, wherein the mating housing abuts against the sealing ring in the plugging direction in the plugged state.

15. The plug assembly of claim 13, wherein a shielding of the mating connector contacts a radial inner surface of the shielding contact in the plugged state.

* * * * *